US005244057A

United States Patent [19]

Renno

[11] Patent Number: 5,244,057

[45] Date of Patent: Sep. 14, 1993

[54] PORTABLE SCAFFOLD

[76] Inventor: Thomas E. Renno, 4336 Maygog Rd., Sarasota, Fla. 34233

[21] Appl. No.: 920,809

[22] Filed: Jul. 27, 1992

[51] Int. Cl.[5] ..... E04G 3/00

[52] U.S. Cl. ..... 182/82; 182/129

[58] Field of Search ..... 182/178, 179, 181, 129, 182/82

[56] References Cited

U.S. PATENT DOCUMENTS

| | | | |
|---|---|---|---|
| 53,768 | 4/1866 | Arrouqier | 182/37 |
| 1,336,141 | 4/1920 | Kelly | 182/45 X |

FOREIGN PATENT DOCUMENTS

| | | | |
|---|---|---|---|
| 687003 | 5/1964 | Canada | 182/119 |
| 475449 | 8/1969 | Switzerland | 182/82 |
| 688070 | 2/1953 | United Kingdom | 182/182 |
| 1127918 | 9/1968 | United Kingdom | 182/224 |

*Primary Examiner*—Alvin C. Chin-Shue
*Attorney, Agent, or Firm*—Charles J. Prescott

[57] ABSTRACT

A portable scaffold for supporting sheet construction material such as plywood ready for use in roof and floor construction. The device is structured to be fully supported atop a wall in straddled fashion, at least a portion of the upper edge of the wall being temporarily clear to receive the scaffold. Two upright elongated legs of each of a pair of frame members are held parallel and spaced apart by an upper elongated horizontal support member and a spacer panel or brace positioned vertically at a mid-point between the legs. The two frame members are held spaced apart and upright by diagonal bracing connectable therebetween. The two support members thus define a generally horizontal plane sized for supporting the sheet construction material thereatop.

8 Claims, 1 Drawing Sheet

PORTABLE SCAFFOLD

BACKGROUND OF THE INVENTION

This invention generally relates to scaffolding and supporting devices, and more particularly to a portable scaffold device supportable atop the upper edge of a wall under construction and structured for supporting a quantity of sheet construction material such as plywood.

Various types of scaffolding devices are presently available for assisting workers in building construction. A scaffold system is disclosed in U.S. Pat. No. 4,867,274 to Langer which teaches a self supported arrangement having vertical posts upwardly extending to support a horizontal worker platform.

Shaffstall in U.S. Pat. No. 4,676,341 discloses an adjustable roof scaffold jack for mounting on a pitched roof to support workmen atop a platform thereof.

In U.S. Pat. No. 4,256,201, Neighbors has invented a scaffolding frame member structured for supporting scaffolding planks along the side of a building beneath the roof eave.

Jacobs, in U.S. Pat. No. 4,909,350 teaches a hook-on scaffolding support connectable to an opened stud wall to provide a horizontal worker's platform abutting against the studs.

An interior scaffolding arrangement is disclosed by Hansen in U.S. Pat. No. 3,679,026 teaching a jack scaffold assembly for use in wall construction. Another free standing scaffold module is disclosed in U.S. Pat. No. 4,773,506.

The present invention provides a portable scaffold which is supportable atop the upper margin of a concrete block wal, a load-bearing wood frame wall, or the like and structured for supporting a quantity of sheet construction material such as plywood. No adjustments or additional attachments are required as the device straddles the wall and is fully supported thereon.

BRIEF SUMMARY OF THE INVENTION

This invention is directed to a portable scaffold for supporting sheet construction material such as plywood ready for use in roof and floor construction. The device is structured to be fully supported atop a wall in straddled fashion, at least a portion of the upper edge of the wall being temporarily clear to receive the scaffold. Two upright elongated legs of each of a pair of frame members are held parallel and spaced apart by an upper elongated horizontal support member and a spacer panel or brace positioned vertically at a mid-point between the legs. The two frame members are held spaced apart and upright by diagonal bracing connectable therebetween. The two support members thus define a generally horizontal plane sized for supporting the sheet construction material thereatop.

It is therefore an object of this invention to provide a portable scaffold for supporting sheet construction materials such as plywood.

It is yet another object of this invention to provide a portable scaffold which is supportable atop and straddling a wall without the need for further supports or attachments.

It is yet another object of this invention to provide a portable scaffold for supporting sheet construction material such as plywood which is economical to manufacture and is easily erectable from a compact stored configuration.

It is still another object of this invention to provide a portable scaffold supportable atop and astride a wall and which will support a flat working surface for use in roof and floor construction.

In accordance with these and other objects which will become apparent hereinafter, the instant invention will now be described with reference to the accompanying drawings.

DETAILED DESCRIPTION OF THE INVENTION

Figure 1:
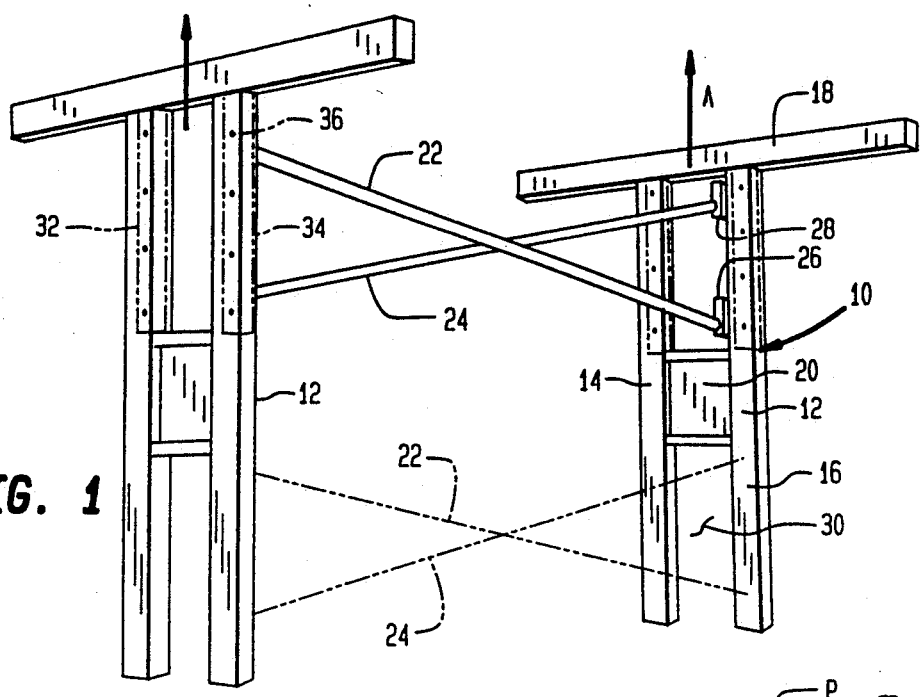
FIG. 1 is a perspective view of the invention showing an alternately positioned diagonal bracing and in telescopic feature in phantom.

Referring now to the drawings, the invention is shown generally at numeral 10 and includes a pair of upright frame members 12. Each of these frame members 12 include two spaced upright legs 14 and 16 formed of tubular channel stock material. Each set of legs 14 and 16 of each frame member 12 are held rigidly spaced apart and parallel by a centrally positioned and connected spacer panel 20 and an elongated horizontal support member 18 as shown. In the preferred embodiment, each frame member 12 is planer.

The frame members 12 are held in upright orientation by two diagonal bracing members 22 and 24 which are boltably connectable to brackets 26 and 28 as shown. In the preferred embodiment, these diagonal members 22 and 24 are positioned upwardly between support member 18 and spacer panel 20. However, in certain situations, it may be preferred to position these diagonal members 22 and 24 lower as shown in phantom below the spacer panels 20. This alternate configuration allows the device to be used on floor joists that are of a certain maximum height.

Note that the device 10 is reduced considerably in size for storage by simply unbolting the diagonal members 22 and 24.

Figure 2:
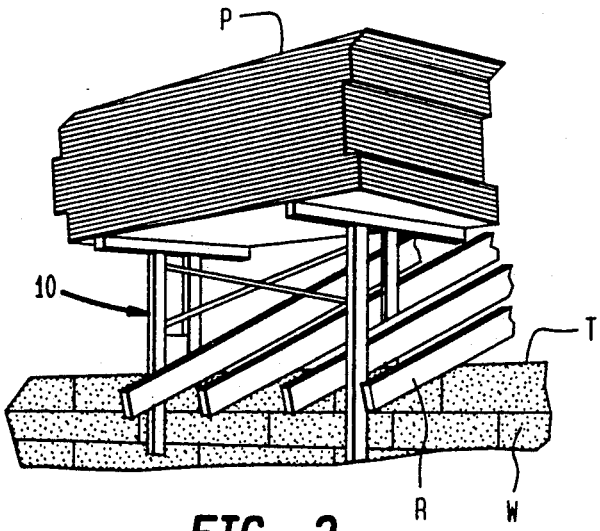
FIG. 2 is a perspective view of the invention in use.
Figure 3:
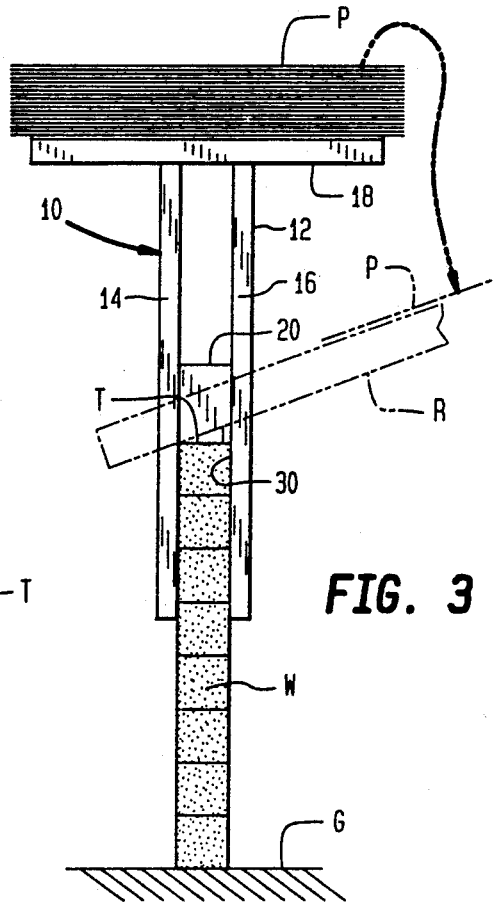
FIG. 3 is an end elevation view of FIG. 2.

As seen in FIGS. 2 and 3, the width of the gap 30 between the legs 14 and 16 below spacer panel 20 is selected so as to be preferably slightly greater than the width of a concrete block wall W which is typically utilized in building construction. However, this should be understood not to be a specific limitation of this invention so that the width of any wall may be accommodated. Thus, the lower ends of legs 14 and 16 will snugly straddle against either side surface of the wall W, sliding downward to a point where the lower edge of spacer panels 20 contact and rest against the top T of the wall W.

This invention 10 is therefore particularly suited for construction situations wherein the roof R is in the process of being constructed and wherein a stack of plywood P may be rested atop the support members 18 which generally define a horizontal plane atop which the plywood P may rest. Because the legs 14 and 16 extend upwardly from spacer panel 20, the plywood stack P is held sufficiently above the roof R so as not to interfere with the ongoing construction process of laying and securing the plywood sheets atop the roof R as shown by the arrow in phantom in FIG. 3.

To render the device upwardly adjustable in the direction of arrows A in FIG. 1, the support members 18 may include upright, downwardly extending channels 32 and 34 which slidably engage within legs 14 and 16 and are secured in a desired vertical position by bolting the arrangement through holes 36.

It should now be more clearly understood that, although the device is extremely simple and economical to manufacture, while nonetheless being fully stable both vertically, laterally and diagonally by utilizing the structural components hereinabove described in a most advantageous way strengthwise. Further, the support structure of a concrete block wall provides considerably more support strength than is required for use in conjunction with this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A portable scaffold for supporting sheet construction material such as plywood in a horizontal position directly above a top surface of a concrete block wall or the like during construction of a building roof to be supported by the wall comprising:

two spaced apart upright frame members each including two spaced apart elongated upright legs connected by a spacer panel positioned at a mid-point along the length of said legs;

an elongated generally horizontal support member connected between the upper ends of said two legs of each said frame member, each said support member generally lying in a plane defined by said two legs of each said frame member and extending in either direction from said legs;

said frame members rigidly held in upright spaced apart relation by elongated diagonal bracing connectable therebetween;

each said two legs of each said frame member spaced apart a distance similar to that of a thickness of the wall, each said frame member being supported atop the wall when said two legs of each said frame member closely straddle the wall, downwardly extending from the top surface of the wall, said spacer panel vertically supporting the corresponding said frame member by contacting against the top surface of the wall, said support members defining a plane sized to horizontally support the sheet construction material thereatop.

2. A portable scaffold as set forth in claim 1, wherein:

said diagonal bracing is connectable at each end thereof to the corresponding said frame member at a vertical position between the corresponding said spacer panel and said support member.

3. A portable scaffold as set forth in claim 1, wherein:

said diagonal bracing is connectable at each end thereof to the corresponding said frame member at a vertical position below the level of corresponding said spacer panel.

4. A portable scaffold as set forth in claim 1, further comprising:

means for telescopically extending and securing said support member with respect to said spacer panel.

5. A portable scaffold for supporting sheet construction material such as plywood in a horizontal position directly above a top surface of a concrete block wall or the like during construction of a building roof to be supported by the wall comprising:

a pair of frame members, each frame member of said frame member pair generally T-shaped having a pair of straight upright spaced apart elongated legs each connected at an upper end thereof evenly spaced along the length of an elongated horizontal support sized in length to receive the width of the sheet construction material;

each said pair of legs having a spacer panel connected therebetween positioned at a mid-point along the length of said pair of legs, each said spacer panel having a width equal to the thickness of the wall, said pair of frame members being supported atop the wall in straddled fashion and prevented from both lateral and downward movement by the wall;

elongated diagonal bracing connectable between each said frame member, spacing and holding said frame members spaced apart and in generally parallel upright orientation a distance similar to the length of the sheet construction material.

6. A portable scaffold as set forth in claim 5, wherein:

said diagonal bracing is connectable at each end thereof to the corresponding said frame member between the corresponding said spacer panel and said support member.

7. A portable scaffold as set forth in claim 5, wherein:

said diagonal bracing is connectable at each end thereof to the corresponding said frame member below the level of corresponding said spacer panel.

8. A portable scaffold as set forth in claim 5, further comprising:

means for telescopically extending and securing said support member with respect to said spacer panel.

* * * * *